US008074726B1

(12) United States Patent
Hall

(10) Patent No.: US 8,074,726 B1
(45) Date of Patent: Dec. 13, 2011

(54) VIBRATORY RIPPER

(76) Inventor: Ronald Hall, Woodstock (CA)

( * ) Notice: Subject to any disclaimer, the term of this patent is extended or adjusted under 35 U.S.C. 154(b) by 0 days.

(21) Appl. No.: 12/906,850

(22) Filed: Oct. 18, 2010

(51) Int. Cl.
*A01B 35/00* (2006.01)

(52) U.S. Cl. ..... 172/40

(58) Field of Classification Search ..... 172/1, 40, 172/56, 272, 554, 699, 165, 667, 735; 405/174, 405/180–183, 271, 303; 404/117, 133.05, 404/133.02

See application file for complete search history.

(56) References Cited

U.S. PATENT DOCUMENTS 3,618,237 A * 11/1971 Davis ..... 37/367
4,087,982 A * 5/1978 Golobay ..... 405/182
4,379,595 A * 4/1983 Roussin et al. ..... 299/37.5
4,909,333 A * 3/1990 Lindstrom ..... 172/40
5,482,121 A * 1/1996 Draney et al. ..... 172/40
6,244,355 B1 * 6/2001 Hall ..... 172/40
7,546,883 B1 * 6/2009 Doering et al. ..... 172/40

* cited by examiner

*Primary Examiner* — Robert Pezzuto
(74) *Attorney, Agent, or Firm* — Katten Muchin Rosenman LLP

(57) ABSTRACT

In an aspect, the invention is directed to a ripping mechanism for a vehicle. The ripping mechanism includes a support frame, a ripping member and an impact mechanism which is configured to reciprocate the ripping member forwardly and rearwardly. The impact mechanism is preferably a vibrator mechanism. In a particular embodiment, the ripping mechanism has a longitudinal axis, is mountable to the vehicle and is movable between a raised position and a lowered position. The ripping member has an engagement head that is configured for plowing a groove in the ground and that is pivotally supported on the support frame about a ripping member pivot axis that is positioned such that pivoting of the ripping member displaces the engagement head longitudinally. The impact mechanism is preferably a vibrator mechanism. The vibrator mechanism is connected to the ripping member wherein activation of the vibrator mechanism causes reciprocating pivoting movement of the ripping member.

9 Claims, 4 Drawing Sheets

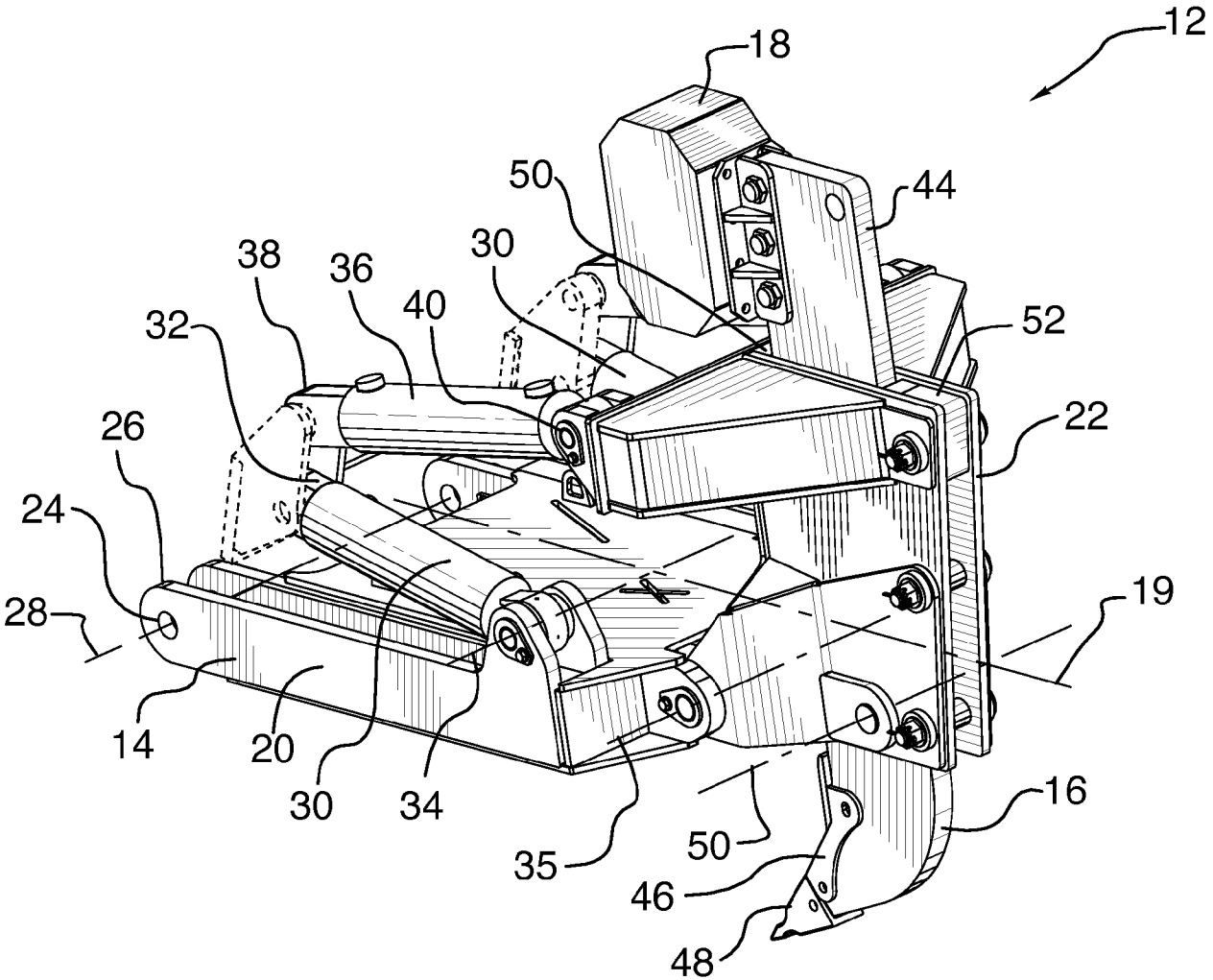
FIG2.a

VIBRATORY RIPPER

FIELD OF THE INVENTION

The present invention relates to plowing, trenching and ripping machines and more particularly to rippers that are used for ripping hard materials, such as rock, concrete and the like.

BACKGROUND OF THE INVENTION

Plowing, trenching and ripping machines are well known machines used for digging trenches or various depths and through various types of material. In certain situations, such as when trying to form a trench through rock, concrete or the like, such machines can encounter some difficulty. It has been proposed in the past to use vibration to assist with such machinery. However, it was ultimately not sufficiently successful.

It would be advantageous to provide a plowing, trenching or ripping machine that at least partially overcame the aforementioned problem.

SUMMARY OF THE INVENTION

In an aspect, the invention is directed to a ripping mechanism for a vehicle. The ripping mechanism includes a support frame, a ripping member and an impact mechanism which is configured to reciprocate the ripping member forwardly and rearwardly. The impact mechanism is preferably a vibrator mechanism.

In a particular embodiment, the ripping mechanism has a longitudinal axis, is mountable to the vehicle and is movable between a raised position and a lowered position. The ripping member has an engagement head that is configured for plowing a groove in the ground and that is pivotally supported on the support frame about a ripping member pivot axis that is positioned such that pivoting of the ripping member displaces the engagement head longitudinally. The impact mechanism is preferably a vibrator mechanism. The vibrator mechanism is connected to the ripping member wherein activation of the vibrator mechanism causes reciprocating pivoting movement of the ripping member.

BRIEF DESCRIPTION OF THE DRAWINGS

The present invention will now be described by way of example only with reference to the attached drawings, in which:

FIG. 2*a* is a perspective view of the ripping mechanism shown in FIG. 1;

DETAILED DESCRIPTION OF THE INVENTION

Figure 1:
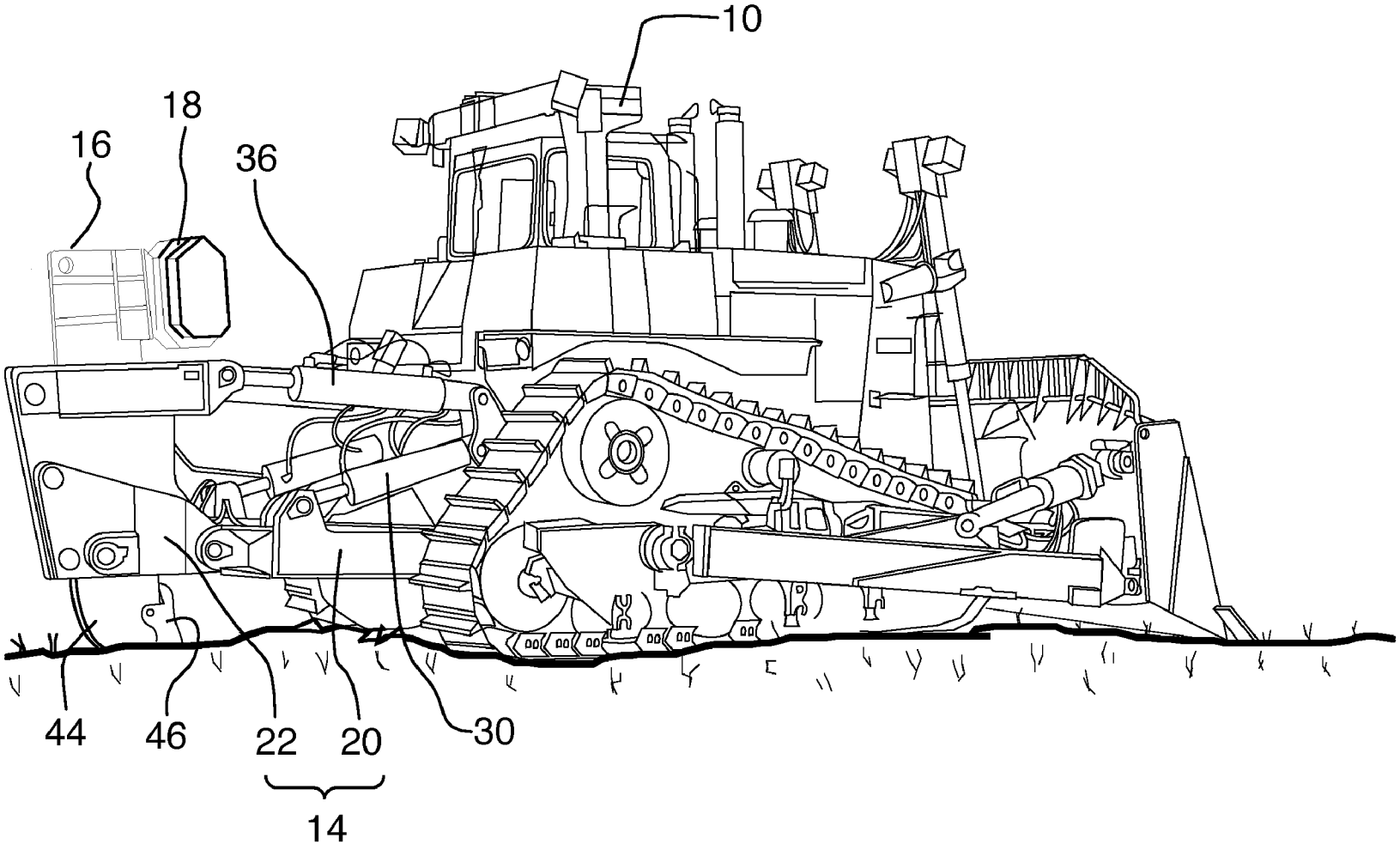
FIG. 1 is a perspective view of a vehicle with a ripping mechanism in accordance with an embodiment of the present invention.

Reference is made to FIG. 1, which shows for a vehicle 10 with a ripping mechanism 12 in accordance with an embodiment of the present invention. The vehicle 10 may be any type of vehicle, such as, for example, a bulldozer, an excavator, a tractor, a trencher, a pipe layer, a brush tractor or a utility plow.

Figure 2B:
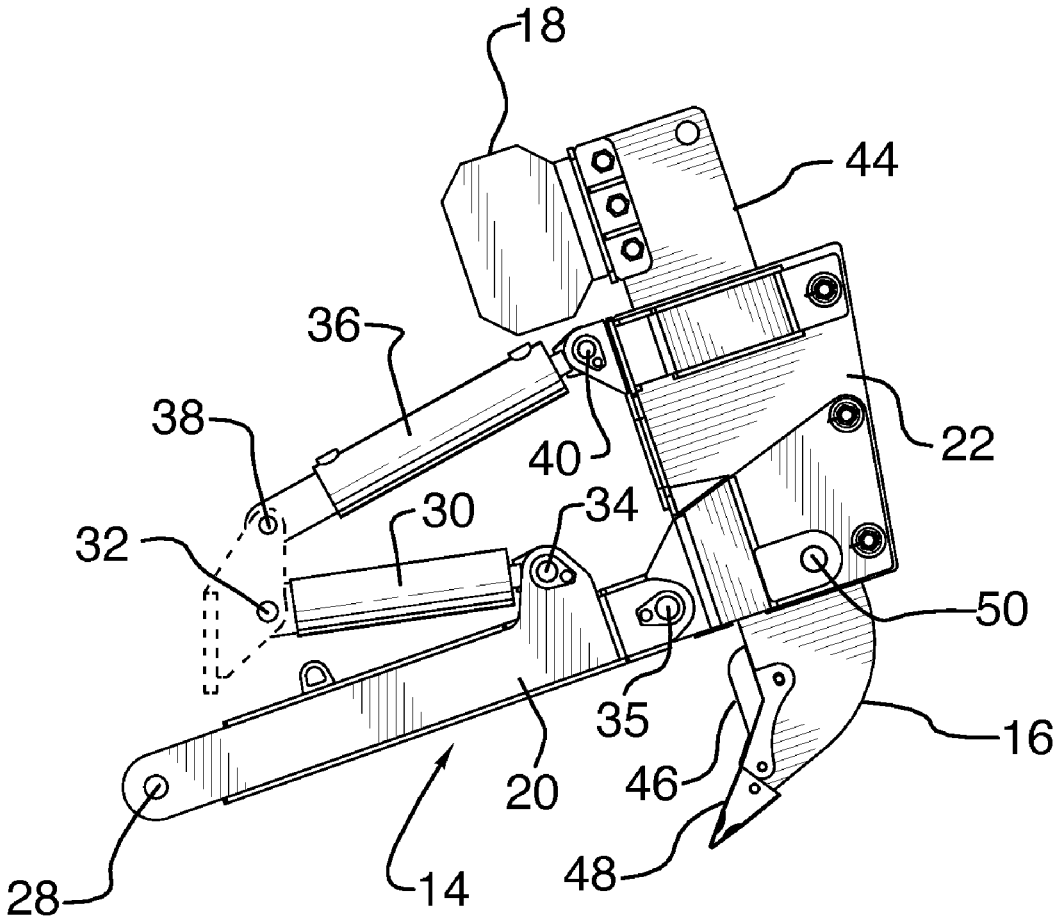
FIG. 2*b* is a side view the ripping mechanism shown in FIG. 1.

The ripping mechanism 12 includes a support frame 14, a ripping member 16 and a vibrator mechanism 18. In the exemplary embodiment shown in FIGS. 2*a* and 2*b*, the support frame 14 has a longitudinal axis shown at 19.

The support frame 14 is mountable to the vehicle 10 and is movable between a raised position (FIG. 2*b*) and a lowered position. FIG. 1 shows the support frame 14 in a partially lowered position.

The support frame 14 includes a main frame portion 20 and a ripping member frame portion 22 that is movably supported on the main frame portion 20. The main frame portion 20 has a pivot connector 24 at its front end (shown at 26) for pivotally connecting to the vehicle 10 about a main frame portion pivot axis 28. At least one main frame adjustment cylinder 30 is provided and is pivotally connectable to the vehicle at a first end 32 and is pivotally connectable at a second end 34 to the main frame portion 20. In this exemplary embodiment, there are two adjustment cylinders 30 (as shown in FIG. 2*a*). The adjustment cylinders 30 are preferably hydraulic cylinders and may be connected to a source of pressurized hydraulic fluid from the vehicle 10. The main frame adjustment cylinders 30 are positioned such that changing the amount of extension of the main frame adjustment cylinders 30 pivots the main frame portion 20 about the main frame portion pivot axis 28 thereby changing the angle of the main frame portion 20 relative to the vehicle 10. Because of the position of the ripping member frame portion 22 relative to the main frame portion pivot axis 28, (ie. because the ripping member frame portion 22 is horizontally offset from the pivot axis 28), extending or retracting the cylinders 30 causes a change in height of the ripping member frame portion 22 relative to the vehicle 10.

Figure 2C:
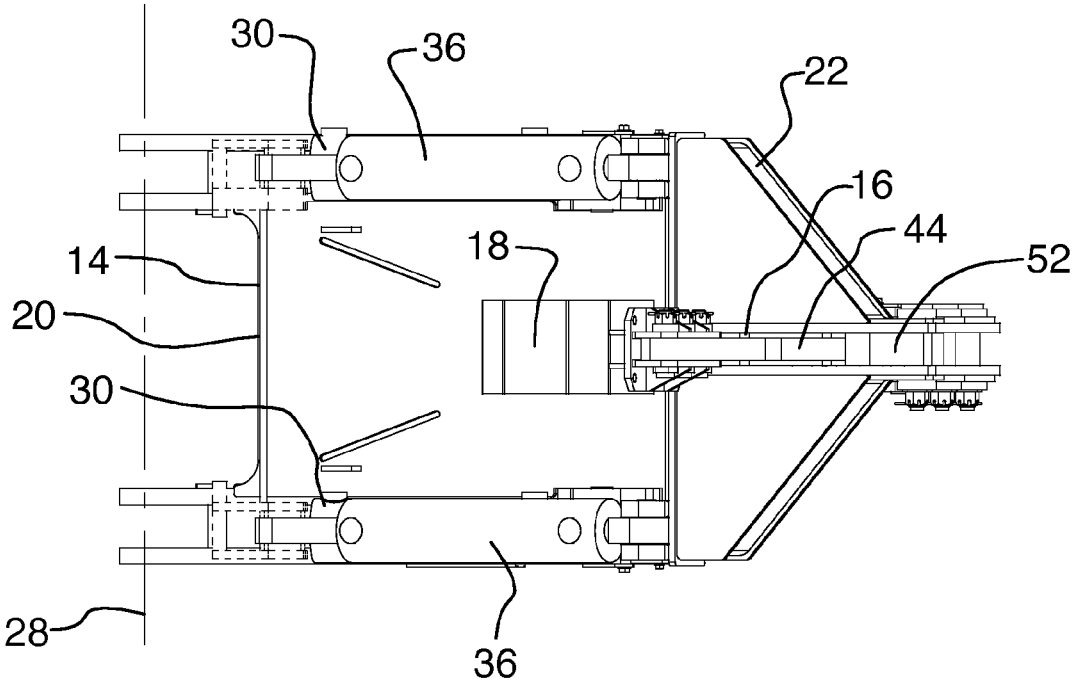
FIG. 2*c* is a top view of the ripping mechanism shown in FIG. 1.

In the exemplary embodiment shown, the ripping member frame portion 22 is pivotally connected to the main frame portion 20 about a ripping member frame pivot axis 35. At least one ripping member adjustment cylinder 36 is provided and is pivotally connectable at a first end 38 to the vehicle 10 and is pivotally connectable at a second end 40 to the ripping member frame portion 22. In this exemplary embodiment, there are two adjustment cylinders 36 (as shown in FIG. 2*c*). The adjustment cylinders 36 are preferably hydraulic cylinders and may be connected to a source of pressurized hydraulic fluid from the vehicle 10. The ripping member adjustment cylinders 36 are positioned such that changing the amount of extension of the ripping member adjustment cylinders 36 pivots the ripping member frame portion 22 about the ripping member frame pivot axis 35.

In the embodiment shown, extending and retracting the main frame adjustment cylinders 30 causes the ripping member frame portion 22 to pivot relative to the main frame portion 20 unless the ripping member adjustment cylinders 36 are simultaneously extended or retracted along with the cylinders 30. It is alternatively possible however, for the ripping member adjustment cylinders 36 to connect at their first ends 38 to the main frame portion 20 and not to the vehicle 10, in which case, extending and retracting the main frame adjustment cylinders 30 would not cause the ripping member frame portion 22 to pivot relative to the main frame portion 20.

The ripping member 16 has a ripping member body 44, a trench wall forming member 46 and an engagement head 48, both of which are removably mountable to the ripping member body 44 via threaded fasteners so that they can be removed and replaced when worn. The engagement head 48 has a selected shape particularly at its leading edge to facilitate breaking up rock, concrete and other hard materials via repeated impact. The ripping member body 44 (and therefore, the ripping member 16) is pivotally supported on the ripping member frame portion 22 about a ripping member pivot axis 50, which extends laterally so that pivoting of the ripping member 24 changes the angle of attack of the engagement head 48.

At least one aft limit member 52 and at least one forward limit member 54 are provided on the ripping member frame portion 22, and are positioned to limit the forward and aftward movement of the ripping member 16 about the ripping member pivot axis 50. The aft and forward limit members 52 and 54 are preferably made from a resilient material such as neoprene.

The vibrator mechanism 18 is connected to the ripping member 16 and in the embodiment shown is mounted solely and directly to the ripping member body 44. Activation of the vibrator mechanism 18 causes reciprocating pivoting movement of the ripping member 16 about the ripping member pivot axis 50 between the forward and aft limit members 54 and 52.

The vibrator mechanism 18 may have any suitable structure. For example, the vibrator mechanism 18 may include a motor that drives a rotating member that is eccentrically weighted as is known in the art of vibrator mechanisms. The motor may be connected to a hydraulic power source from the vehicle 10. Alternatively the motor could be an electric motor, or any other suitable kind of motor.

It will be noted that, while the angle of attack of the engagement head 52 is adjustable, the movement of the engagement head 52 is substantially longitudinal due to its position being substantially directly vertically offset from the ripping member pivot axis 50 when the ripper mechanism 12 is in a lowered position suitable for ripping. While this is advantageous, it is not necessary, and it is possible for the engagement head 52 to move in a direction that is largely longitudinal but that has a significant vertical component.

While the above description constitutes a plurality of embodiments of the present invention, it will be appreciated that the present invention is susceptible to further modification and change without departing from the fair meaning of the accompanying claims.

The invention claimed is:

1. A ripping mechanism for a vehicle, comprising:

a support frame having a longitudinal axis, wherein the support frame is mountable to the vehicle and is movable between a raised position and a lowered position;

a ripping member having an engagement head that is configured for plowing a groove in the ground and that is pivotally supported on the support frame about a ripping member pivot axis that is positioned such that pivoting of the ripping member displaces the engagement head largely longitudinally; and a vibrator mechanism mounted to the ripping member wherein activation of the vibrator mechanism causes reciprocating pivoting movement of the ripping member.

2. A ripping mechanism as claimed in claim 1, wherein the vibrator mechanism is mounted solely to the ripping member.

3. A ripping mechanism as claimed in claim 1, wherein the vibrator mechanism includes a motor that includes an eccentrically weighted rotating member.

4. A ripping mechanism as claimed in claim 1, wherein the support frame includes at least one aft limit member and at least one forward limit member, wherein the forward and aft limit members are connected to the support frame and are positioned to limit the forward and aftward movement of the ripping member about the ripping member pivot axis.

5. A ripping member mechanism as claimed in claim 4, wherein the forward and aft limit members are made from a resilient material.

6. A ripping mechanism as claimed in claim 1, wherein the support frame includes a main frame portion and a ripping member frame portion that is movably supported on the main frame portion, wherein the ripping member frame portion pivotally supports the ripping member about the ripping member pivot axis.

7. A ripping mechanism as claimed in claim 6, wherein the main frame portion has a pivot connector at a front end for pivotally connecting to the vehicle about a main frame portion pivot axis, and wherein the ripping mechanism further comprises at least one main frame adjustment cylinder that is pivotally connectable to the vehicle and pivotally connectable to the main frame portion, and positioned such that changing the amount of extension of the at least one main frame adjustment cylinder pivots the main frame portion about the main frame portion pivot axis to control the vertical position of the ripper member frame portion relative to the vehicle.

8. A ripping mechanism as claimed in claim 7, wherein the ripping member frame portion is pivotally connected to the main frame portion about a ripping member angle pivot axis, and wherein the ripping mechanism further comprises at least one ripping member adjustment cylinder that is pivotally connectable to the vehicle and pivotally connectable to the ripping member frame portion, and positioned such that changing the amount of extension of the at least one ripping member adjustment cylinder pivots the ripping member frame portion about the ripping member angle pivot axis to control the angle of attack of the ripping member.

9. A ripping mechanism as claimed in claim 1, wherein the ripping member has a top and a bottom, and wherein the engagement head is positioned at the bottom of the ripping member, and wherein the vibrator mechanism is positioned at the top of the ripping member, and wherein the pivot axis is vertically closer to the bottom of the ripping member than to the top of the ripping member.

* * * * *